United States Patent [19]

Kopse

[11] 4,339,080

[45] Jul. 13, 1982

[54] FUEL INJECTION NOZZLE

[75] Inventor: Odon Kopse, Stuttgart, Fed. Rep. of Germany

[73] Assignee: Robert Bosch GmbH, Stuttgart, Fed. Rep. of Germany

[21] Appl. No.: 183,554

[22] Filed: Sep. 2, 1980

Related U.S. Application Data

[63] Continuation of Ser. No. 946,271, Sep. 27, 1978, abandoned.

[30] Foreign Application Priority Data

Nov. 4, 1977 [DE] Fed. Rep. of Germany ..... 2749378

[51] Int. Cl.[3] ..... F02M 61/00

[52] U.S. Cl. ..... 239/533.3

[58] Field of Search ..... 239/115, 452, 453, 533.3–533.12, 239/533.15, 541, 563

[56] References Cited

U.S. PATENT DOCUMENTS

| | | | |
|---|---|---|---|
| 1,986,418 | 1/1935 | Smith | 239/533.6 |
| 2,003,814 | 6/1935 | Taylor | 239/533.7 |
| 2,295,081 | 9/1942 | Harvath | 239/533.7 |
| 2,592,111 | 4/1952 | Bischof | 239/533.7 |
| 4,096,995 | 6/1978 | Klomp | 239/533.8 X |

FOREIGN PATENT DOCUMENTS

| | | | |
|---|---|---|---|
| 121385 | 5/1946 | Australia | 239/533.7 |
| 925344 | 9/1947 | France | 239/453 |

*Primary Examiner*—Johnny D. Cherry
*Attorney, Agent, or Firm*—Edwin E. Greigg

[57] ABSTRACT

A fuel injection nozzle having a needle valve in which the injection ports are formed within the valve needle instead of within the nozzle body and a control opening located in the nozzle body for controlling the injection ports; the control opening being large enough to avoid clogging and capable of controlling one or more injection ports during the needle valve stroke.

4 Claims, 2 Drawing Figures

FUEL INJECTION NOZZLE

This is a continuation, of application Ser. No. 946,271, filed Sept. 27, 1978, now abandoned.

BACKGROUND OF THE INVENTION

The invention relates to a fuel injection nozzle for internal combustion engines which has a needle valve operable in response to fuel delivered thereto under pressure to open and close injection ports for injecting fuel into a combustion chamber. In known fuel injection nozzles of this type there is the disadvantage in that the injection ports clog with carbon from time to time. As a result, not only the atomization of the fuel but also the alignment of the jets of fuel are altered undesirably. In some cases some of the injection ports clog completely.

OBJECT AND SUMMARY OF THE INVENTION

The fuel injection nozzle of this invention with a control opening in the nozzle body and with injection port means in the valve needle has the advantage over the prior art nozzles in that injection port means themselves can no longer clog with carbon. The control opening, in contrast, is so large that there is no danger of carbonization causing complete stoppage.

Accordingly, it is a principal object of this invention to provide a fuel injection nozzle in which the injection port means may be operated carbon free and which provides better atomization of fuel and better alignment of the jets of fuel over a prolonged period of time.

In the advantageous embodiment of this invention the control opening located in the nozzle body is capable of controlling a plurality of injection ports located in the needle valve one after another during the stroke of the needle valve.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
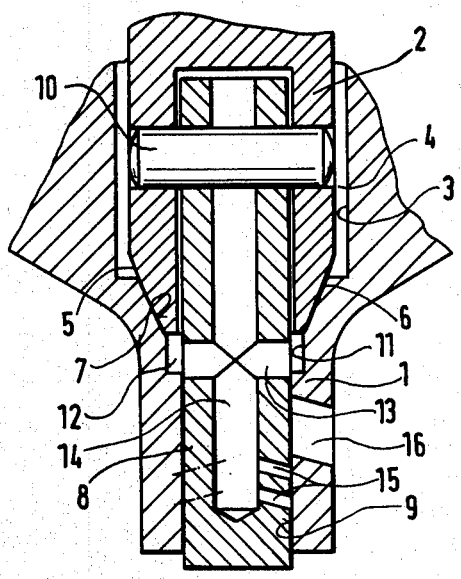
FIG. 1 is a partial sectional view of an exemplary embodiment of a fuel injection nozzle according to the invention is simplified form.

Within a nozzle body 1, a valve needle 2 is arranged to axially move and which together with an inner bore 3 of the nozzle body 1 defines a pressure space 4. In the vicinity of the pressure space 4, there is a pressure shoulder 5 formed on the valve needle 2, upon which the fuel under pressure acts to urge the valve needle 2 in the opening direction. A tapered end on the valve needle 2 is pressed onto a valve seat 7 formed on the nozzle body 1 by means of a closing force (not shown) which may be, for example, a spring.

A piston 8 projects from the end of the valve needle 2 which is slidable into a bore 9 of the nozzle body 1 in a fluid-tight fit. This piston 8 can be integral with the valve needle 2; however, it can also, as in the exemplary embodiment, be a separate projection coupled to the valve needle 2 by means of a bolt 10. The bore 9 is formed with a section 11 of larger diameter and opens into the conical valve seat 7. This section 11 thus forms an annular space 12 between the piston 8 and the nozzle body 1. A transverse bore 13 of the piston 8 is in constant communication with this annular space 12 and is intersected by a longitudinal bore 14 in the piston 8. A plurality of injection ports 15 branch off from the longitudinal bore 14 in a transverse direction which, in the exemplary embodiment in the position shown, are covered by the cylinder wall of bore 9. Above this point toward the annular space 12, i.e., between injection ports 15 and the annular space 12, the nozzle body 1 is perforated by a control opening 16.

As soon as the fuel, which has been delivered to the pressure space 4 by an injection pump (not shown), has attained a sufficient pressure, the valve needle 2 is lifted from the valve seat 7 and the piston 8 is displaced within the bore 9. The valve needle 2 is displaced to a greater or lesser extent, so that a greater or lesser number of injection ports 15 is uncovered one after another by the control opening 16 depending on the amount of delivered pressure of the delivered fuel.

After the uncovering of one or more of the injection ports 15 the fuel is injected from the pressure space 4 via the annular space 12, the bores 13, 14, the injection ports 15 and the control opening 16 into the combustion chamber. Then, as soon as the fuel delivery is interrupted, the valve needle 2 is again seated on the valve seat 7, which separates the injection ports 15 from the control opening 16 and leaves them again covered by the cylinder wall of the bore 9. It is to be noted that the control opening 16 is larger than the injection ports 15; actually large enough to accommodate and control more than one injection port.

Figure 2:
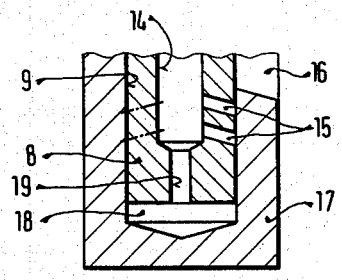
FIG. 2 is a partial detail of a sectional view of a fuel injection nozzle showing an alternate embodiment.

As is shown in FIG. 2, the nozzle body can be formed with a closed extension such as shown at 17. In such a case, a blind space 18 thus formed would either communicate with the longitudinal bore 14 via a bore 19 or with the spring space via a relief bore (not shown).

The foregoing relates to two preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a nozzle body with a control bore and a fuel exit;

a valve needle extending within the control bore toward the fuel exit;

a piston on said valve needle and arranged in a fluid-tight fit within the control bore of the nozzle body in the vicinity of the fuel exit, wherein said valve needle and piston are displaced against the direction of fuel flow through a given stroke within the control bore relative to the fuel exit; and a channel in said piston which serves to carry fuel;

the improvement wherein at least one injection port is located in the piston in communication with said channel, and the fuel exit defines a control opening located in the nozzle body, said control opening having a larger cross-section than said at least one injection port and serving to control the opening and closing of said at least one injection port during the stroke of the valve needle and piston; and wherein the nozzle body defines a valve seat within the control bore and wherein the piston extends downstream of the valve seat.

2. A fuel injection nozzle as claimed in claim 1, wherein the channel extends essentially longitudinally to the piston and said at least one injection port extends essentially transversely thereto.

3. A fuel injection nozzle as claimed in claim 2, wherein a plurality of injection ports are located in the piston, and in communication with said channel, and arranged such that the injection ports are sequentially opened and closed by the control opening during the stroke of the valve needle and piston.

4. A fuel injection nozzle as claimed in claim 3, wherein said control opening is larger than any one of said injection ports and capable of opening more than one of said injection ports to a combustion chamber during the stroke of the valve needle and piston.

* * * * *